US006315483B1

(12) United States Patent
Velliquette

(10) Patent No.: US 6,315,483 B1
(45) Date of Patent: Nov. 13, 2001

(54) ONE-PIECE FLUID CONTROL VALVE FOR FLUID DISPENSERS

(76) Inventor: Stephen P. Velliquette, 4411 Bee Ridge Rd., No. 593, Sarasota, FL (US) 34233

( * ) Notice: Subject to any disclaimer, the term of this patent is extended or adjusted under 35 U.S.C. 154(b) by 0 days.

(21) Appl. No.: 09/675,477

(22) Filed: Sep. 29, 2000

(51) Int. Cl.[7] ..... A46B 11/04

(52) U.S. Cl. ..... 401/278; 401/270; 401/187; 401/183; 224/490; 224/494

(58) Field of Search ..... 401/278, 270, 401/187, 188 R, 189, 183, 184, 185, 263, 264; 222/491, 494, 490; 137/843, 844, 849

(56) References Cited

U.S. PATENT DOCUMENTS

| | | | | |
|---|---|---|---|---|
| D. 359,970 | | 7/1995 | Szabo . | |
| 2,135,237 | * | 11/1938 | Lewis et al. | 222/490 |
| 3,586,068 | | 6/1971 | Nicholson . | |
| 3,618,825 | | 11/1971 | Clarke . | |
| 4,090,647 | | 5/1978 | Dunning . | |
| 4,179,051 | | 12/1979 | Thomas . | |
| 4,420,101 | | 12/1983 | O'Neill . | |
| 4,483,465 | | 11/1984 | Lawrence . | |
| 5,071,017 | | 12/1991 | Stull . | |
| 5,492,253 | | 2/1996 | Proshan . | |
| 5,573,033 | | 11/1996 | Litzel . | |
| 5,839,626 | | 11/1998 | Gross et al. . | |
| 5,927,566 | | 7/1999 | Mueller . | |
| 5,927,567 | * | 7/1999 | Fillmore | 222/490 |
| 5,934,514 | | 8/1999 | Lampe et al. . | |
| 6,062,436 | | 5/2000 | Fuchs . | |
| 6,089,419 | | 7/2000 | Gross . | |

* cited by examiner

*Primary Examiner*—David J. Walczak
(74) *Attorney, Agent, or Firm*—Charles J. Prescott

(57) ABSTRACT

A one-piece fluid flow control valve for use in a fluid applicator tip which is connectable onto an open end of a resiliently squeezable bottle. The valve includes a cup-shaped body formed of resilient plastic material having a generally U-shaped longitudinal cross section which defines a hollow interior with an open end and a closed end. The body configured for coaxial alignment and seated retention within a mating interior surface of the applicator tip with the closed end oriented downstream of fluid flow through the applicator tip with respect to the open end. A normally closed slit formed into the body in close proximity to the closed end defines a flap, the slit automatically opening to permit fluid entering into the hollow interior to flow through the opened the slit when the bottle is held in an inverted orientation and squeezed to increase fluid pressure against the closed end to deflect the flap and open the slit. The slit automatically closes when there is no substantial pressure within the bottle, preventing substantial fluid flow there-through while also permitting air to flow therethrough in a reverse or upstream direction, the air drawn into the bottle after the bottle has been squeezed into a resilient distorted configuration to expel fluid and then released.

15 Claims, 4 Drawing Sheets

ONE-PIECE FLUID CONTROL VALVE FOR FLUID DISPENSERS

BACKGROUND OF THE INVENTION

1. Scope of Invention

This invention relates generally to fluid dispensers, and more particularly to a one-piece fluid control valve for such fluid dispensers.

2.Prior Art

In dispensing light fluids from a squeezable fluid dispenser, many times more fluid than needed is inadvertently forced from the bottle or reservoir. This occurs because there is no convenient means for instantly arresting the flow of fluid from the applicator tip or cap attached to the bottle itself when inverted for dispensing fluid. Such an applicator tip may take the form of a brush, a grout roller, a spout, a nozzle and the like. Many prior art devices have attempted to resolve this problem of excess fluid dispensing and dripping, but they have either been too expensive or difficult to manufacture or failed to operate as intended.

U.S. Pat. No. 5,927,566 invented by Mueller discloses a one-piece dispensing system for a container and a method for making same. The dispensing valve includes an orifice.

A dispensing structure with a lid containing a pressure-openable valve is disclosed in U.S. Pat. No. 6,089,419 invented by Gross. The lid includes a flexible valve with self-sealing slits which open to permit flow therethrough in response to pressure on the side of the valve.

Proshan, in U.S. Pat. No. 5,492,253, discloses a cap attachment having a flat disc with a socket adapted to receive the open end of the neck of a bottle. The disc has a slot centered therein and a vertical spout integral therewith.

U.S. Pat. No. 5,934,514 issued to Lampe, et al. teaches a dispensing valve closure which includes a self-sealing dispensing valve. An inner seal within the closure allows for sealing. Lawrence, in U.S. Pat. No. 4,483,465, teaches a valve for dispensing fluids. The valve housing has a diaphragm disposed therein having at least one aperture for allowing passage of fluids.

A one-piece check valve for use in an applicator tip for dispensing fluids is taught in U.S. Pat. No. 4,179,051 issued to Thomas. The valve comprises a reed and valve seat and a hinge section permitting the reed and valve seat to be folded over so that the reed portion seats on the seat provided by the valve seat portion. Fluid will pass through the check valve but any back-flow is prevented by engagement of the reed on the shoulder portion.

Stull, in U.S. Pat. No. 5,071,017 discloses a valve-type closure with a resilient diaphragm containing a slit for the passage of fluids. The slit portion has abuttable, cooperative structures on one side which come into forcible abutment and open the slit as the slit portion bulges.

O'Neill discloses a squeeze bottle with a self-venting dispensing closure in U.S. Pat. No. 4,420,101. The bottle cap contains a flexible disc having an annular valve being shiftable to positions upstream and downstream of the valve seat responsive to pressure within the bottle.

U.S. Pat. No. 5,573,033 teaches a non-drip valve for discharging liquid having at least one elastic member which reduces its volume when the pressure of the fluid increases thereby freeing the through-flow channel.

A flexible vented self-sealing dispensing valve is taught by Fuchs in U.S. Pat. No. 6,062,436. The self-sealing closure assembly includes a dispensing valve of one-piece integrally molded elastic construction with a mouth portion that includes a slit opening oriented diametrically of the annular base.

Dunning teaches a squeeze bottle container with a cap containing a tapered spout with an opening therethrough in U.S. Pat. No. 4,090,647. A closure cap is provided with a tongue to enhance the seal.

U.S. Pat. No. 5,839,626, issued to Gross, et al. teaches a closure having a dispensing valve with an orifice to permit liquid flow therethrough responsive to increased pressure within the container. An outer member on the base of the valve functions as a flow baffle for protecting the valve.

A one-piece valve adapted for use in pressurized containers for either charging the container or dispensing the contents therefrom is shown in U.S. Pat. No. 3,586,068. This fluid pressure responsive valve is made as a single unitary piece with fluid passage means formed therein and a plug which is compressible to seal the passages when fluid pressure forces are imposed on the valve. Design patent D359,970, issued to Szabo, discloses a plug cap having a slit therethrough.

The present invention teaches a very economical to manufacture and simplistic one piece fluid check valve having structure cooperative with the tip of a squeezable fluid dispensing container which automatically self closes the instant that squeezing pressure against the sides of the resilient container is released. Moreover, the invention thereafter allows air to reenter the container, which has been squeezed and distorted, to resiliently return to its normal configuration without fluid spillage.

BRIEF SUMMARY OF THE INVENTION

This invention is directed to a one-piece fluid flow control valve for use in a fluid applicator tip which is connectable onto an open end of a resiliently squeezable bottle. The valve includes a cup-shaped body formed of resilient plastic material having a generally U-shaped longitudinal cross section which defines a hollow interior with an open end and a closed end. The body is configured for coaxial alignment and seated retention within a mating interior surface of the applicator tip with the closed end oriented downstream of fluid flow through the applicator tip with respect to the open end. A normally closed slit formed into the body in close proximity to the closed end defines a flap, the slit automatically opening to permit fluid entering into the hollow interior to flow through the opened slit when the bottle is held in an inverted orientation and squeezed to increase fluid pressure against said closed end to deflect the flap and open the slit. The slit automatically closes when there is no substantial pressure within the bottle, preventing substantial fluid flow therethrough while also permitting air to flow therethrough in a reverse or upstream direction, the air drawn into the container after being released.

It is therefore an object of this invention to provide an economical, easy to install fluid control valve for use in fluid applicators having an applicator tip into which the device is insertable.

Still another object of the invention is to provide a one-piece fluid control valve for squeezable containers having an applicator tip which not only provides instant fluid flow stoppage, but also allows air to reenter into the squeezed container so that it resumes its normal configuration when released.

In accordance with these and other objects which will become apparent hereinafter, the instant invention will now be described with reference to the accompanying drawings.

DETAILED DESCRIPTION OF THE INVENTION

Figure 1:
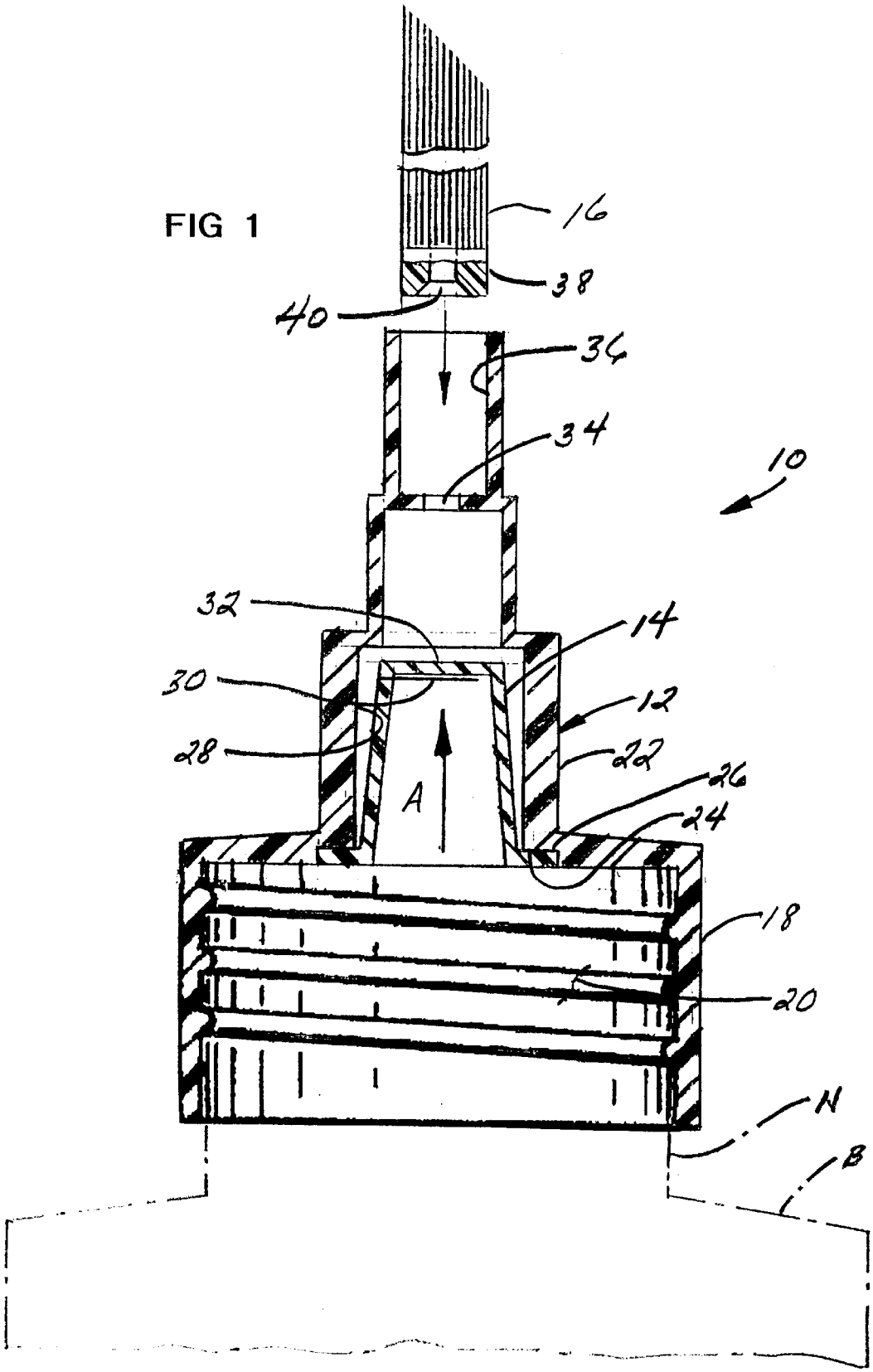
FIG. 1 is a side elevation section view of the invention installed into a cooperatively structured fluid applicator tip including a brush, a flexible container shown in phantom attached to the applicator tip.
Figure 2:
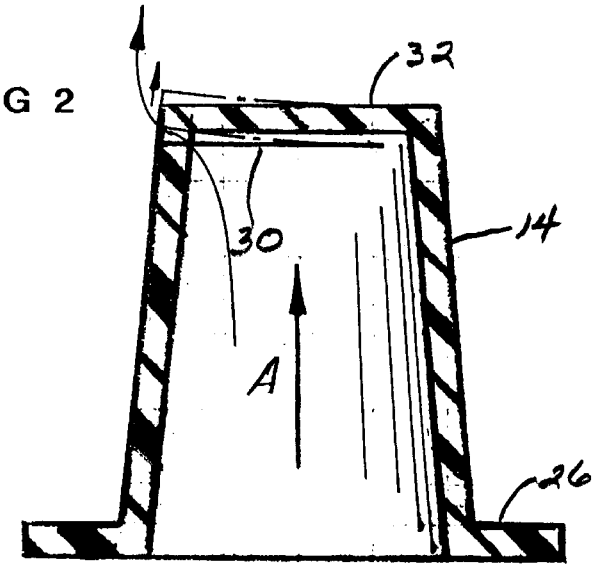
FIG. 2 is a side elevation section view of the fluid flow control valve shown in FIG. 1.

Referring now to the drawings and particularly to FIGS. 1 and 2, a combination applicator tip 12 and squeezable container B shown in phantom is generally shown at numeral 10. The squeezable container B is of a conventional nature typically made of molded plastic material and having a threaded neck N. The fluid applicator tip 12 includes a threaded portion 20 within connector body 18 which matably engages onto the open neck N of the container B in a conventional manner. The size of the threaded portion 20 is reduced in stepped fashion in the preferred embodiment as shown by cylindrical segments beginning at segment 22 which has an interior surface configuration to matably and snugly receive a fluid flow control valve 14 described in more detail herebelow.

The distal or downstream end of the applicator tip 12 has an interior cylindrical surface 36 which is sized to snugly and retainingly receive a molded brush tip 16 formed of flexible synthetic bristles which are heat formed together at the base 38 thereof into a solid plug with a fluid passage 40 formed centrally therethrough for fluid passage from the applicator tip 12 into the bristles 16 for dispensing onto a work surface. A flow restricting aperture 34 is also provided to limit the maximum flow of fluid therethrough.

As seen in FIG. 2, the fluid flow control valve 14 includes a cup-shaped body formed of resilient uniform wall thickness plastic material injection molded of polyethylene plastic. In this preferred embodiment, the side wall is generally configured as a truncated cone having a transverse closed end 32 and an open end defined by an annular outwardly extending flange 26. The flange 26, as seen in FIG. 1, is matably insertable into a mating annular cavity 24 of the applicator tip 12. The tapered side wall provides additional clearance between the cylindrical interior surface 28 and the closed end 32 for total freedom of opening and closing movement of the closed end 32 and slit 30 as will now be described. Again, as seen in FIG. 2, a slit or cut 30 has been formed transversal orthogonal to the longitudinal axis of the valve 14. The slit 30 extends from one edge of the closed end 32 toward, but not to, the opposite side thereof a distance of at least half of the diameter of the closed end 32, and preferably in the range of seventy to eighty percent (70%–80%) of the diameter of the closed end 32.

When fluid pressure is introduced into the interior of the valve 14 in the direction of arrow A by inverting and squeezing the container B filled with a fluid, the slit 30 is opened by static pressure against the interior surface of the closed end 32 in the direction of arrow A. Immediately upon opening of slit 30 as shown by the small arrow, fluid flows therethrough in the direction of the fluid flow arrow until the increased pressure within the container B is dropped by releasing the squeezing force against the side wall of the container B. Instantly, when internal fluid pressure is released, the flap formed by the portion of the closed end 32 which extends along slit 30 immediately resiliently returns to the relaxed orientation shown in solid in FIG. 2 to close slit 30 sufficiently to totally prevent further fluid flow therethrough until the bottle B is again squeezed.

An important feature of the present invention is with respect to its ability to allow air to reenter the previously squeezed and now released bottle B through slit 30 while still preventing any substantial leakage of fluid in the opposite direction. Although the exact nature of the surface distortion which occurs in forming slit 30 as described herebelow is unknown, it is presumed that very slight surface imperfections are created along slit 30 sufficient to allow air to bleed back into the squeezed bottle, drawn there by the vacuum pressure which remains within the container until the side configuration is relaxed to the at-rest shape.

Figure 3:
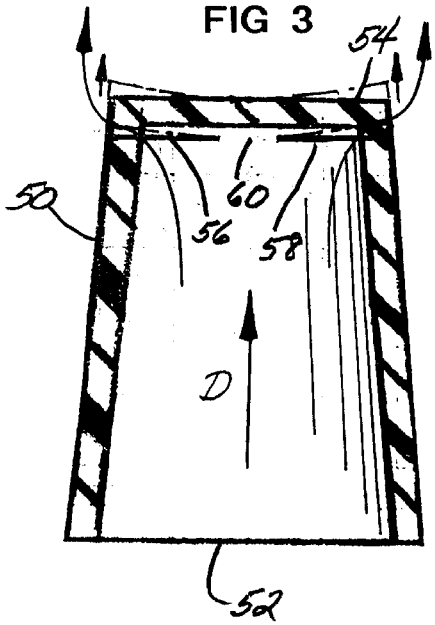
FIG. 3 is an alternate embodiment of the fluid flow control valve.

Referring now to FIG. 3, an alternate embodiment of the fluid flow control valve is shown at 50, again formed of injection molded polyethylene thin walled plastic of uniform thickness. However, in this embodiment 50, the open end 52 thereof is unflanged for supported mating engagement within an interior surface of a comparably configured applicator tip generally as previously described. Two opposing slits 56 and 58 are formed into opposite side wall surfaces immediately adjacent the closed end 54, each slit 56 and 58 extending toward, but not to, the longitudinal central axis of the valve 50 leaving an uncut portion 60 therebetween. By this arrangement, fluid pressure in the direction of arrow D causes each of the slits 56 and 58 to open as shown in phantom in the direction of the small arrow so that fluid will flow therethrough also in the direction of the flow arrows.

Figure 4:
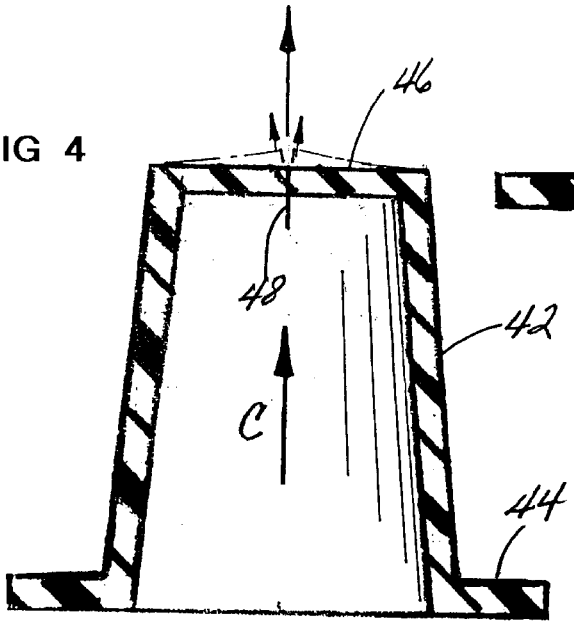
FIG. 4 is yet another alternate embodiment of the fluid flow control valve.
Figure 5:
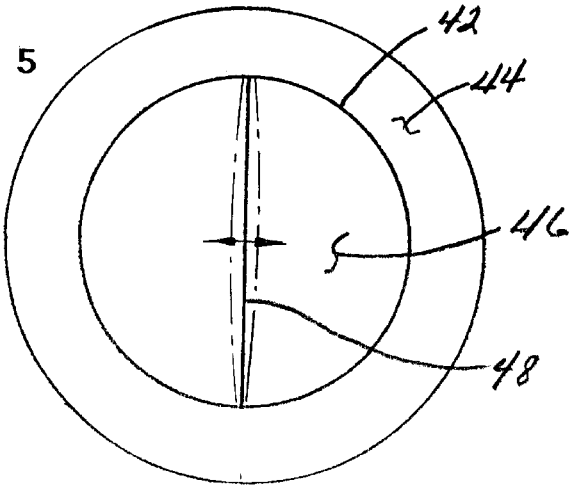
FIG. 5 is a top plan view of FIG. 4.

In FIGS. 4 and 5, still another alternate embodiment of the invention is there shown at 42 having an overall configuration, including flange 44 similar to that shown in FIG. 2. However, in this embodiment 42, a slit 48 has been formed along the longitudinal center line of the valve 42 and through the center of the closed end 46. by this arrangement, fluid pressure in the interior of the valve 42 causes fluid to flow in the direction of arrow C when that internal static pressure causes slit 48 to open as best seen in phantom in FIG. 5.

In all of these embodiments, the elasticity and resiliency of the plastic molded material utilized causes each of the slits to immediately return to the at-rest closed configuration so that fluid flow is immediately and automatically stopped when the squeezing pressure on the side walls of the bottle B is released. Thereafter, air is allowed to seep through the respective slits into the interior of the container B until the side wall distortion and internal vacuum caused by squeezing is returned to a natural at-rest configuration. In that regard, an important aspect of the invention is that the valve establishes a sealed contact within the mating surface of the applicator tip.

Figure 6:
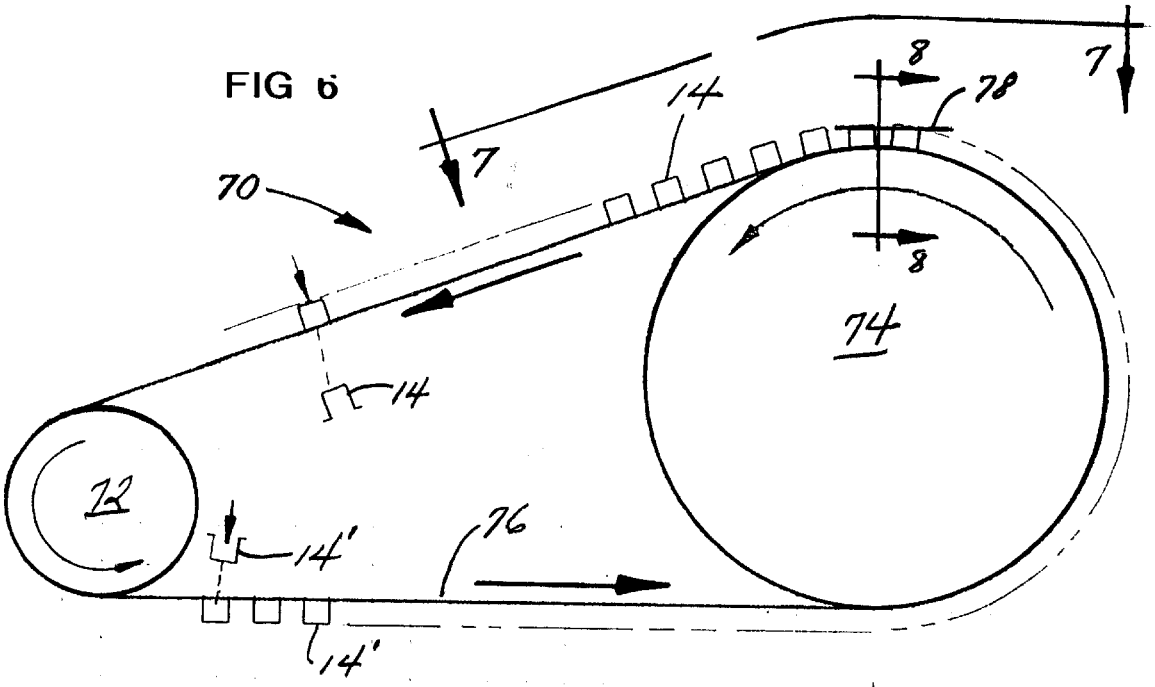
FIG. 6 is a side elevation schematic view of an apparatus utilized to perform the slitting operation to produce the preferred embodiment of the invention shown in FIG. 2.
Figure 7:
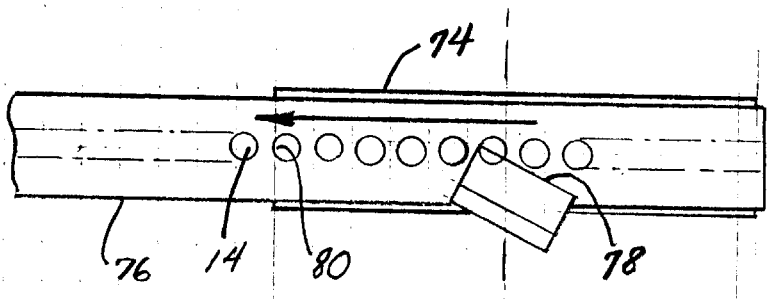
FIG. 7 is a view in the direction of arrows 7—7 in FIG. 6.
Figure 8:
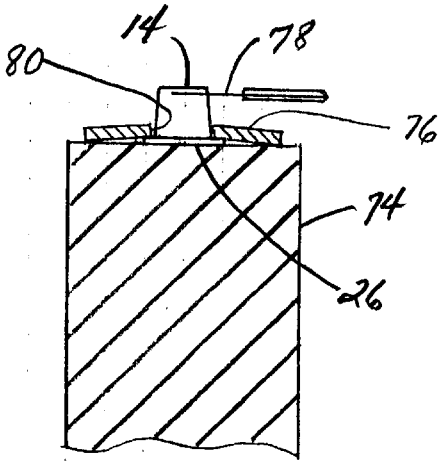
FIG. 8 is a section view in the direction of arrows 8—8 in FIG. 6.

Turning now to FIGS. 6, 7 and 8, the preferred apparatus for imparting the slit into the preferred embodiment of the valve shown in FIG. 2, is there shown generally at numeral 70. The apparatus 70 includes two spaced pulleys 72 and 74, pulley 72 being the drive pulley, while pulley 74 is driven by an interconnected tensioned continuous belt 76.

The belt 76 includes a plurality of longitudinally extending spaced apertures 80 which are sized to snugly receive one control valve shown at 14' prior to slitting. Each of the unslit control valves 14' are inserted into successive apertures 80 in a downward orientation as shown. As the belt 76 moves along, each of the unslit control valves 14' are held securely against the periphery of the pulley 74 as best seen in FIG. 8 by entrapping flange 26 between the belt 76 and the periphery of the pulley 74.

A slitting knife 78 in the form of a conventional single-edge razor blade is securely mounted and immobilized as shown in FIGS. 6, 7 and 8, angled acutely to the direction of feed as seen in FIG. 7 and extending parallel to the outer surface of the belt 76 and spaced apart a distance from the flange 26 slightly less than the overall height of the control valve 14 as seen in FIG. 8 so as to impart a slit 30 into each of the uncut control valves 14' which becomes the final control valve 14. By this arrangement, slight rotation or lateral movement on the razor blade 78 is easily accomplished to vary the depth of the slit 30. After the slitting operation, each of the control valves 14 is simply tapped in the direction of the arrow to fall free of the belt 76.

To enable each of the unslit control valves 14' to be manually inserted and for each of the slitted control valves 14 to be dislodged from corresponding apertures in the belt 76, a slow lineal feed rate of approximately ½" per second is accomplished by rotating the driving pulley 72 having a diameter of 1½" at a speed of 7 rpm which produces a rotational speed of about 1 rpm of pulley 74.

Figure 9:
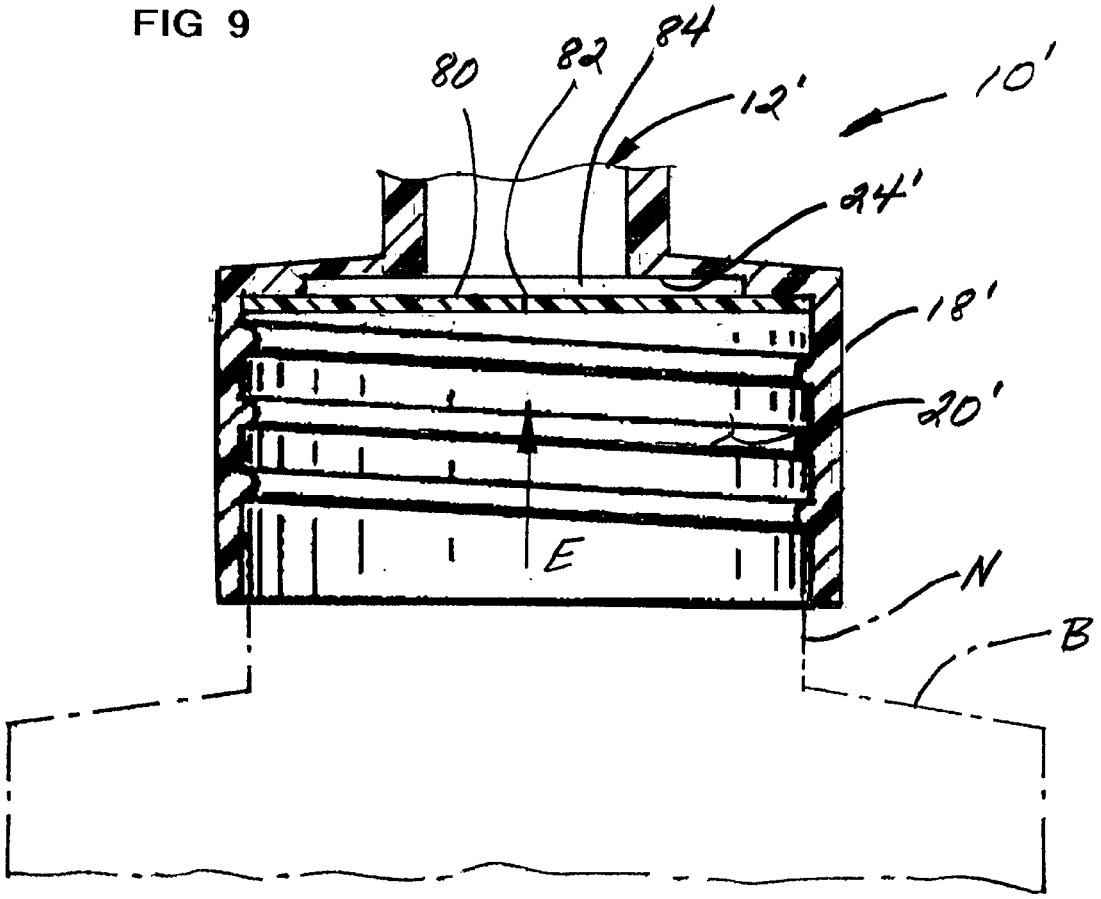
FIG. 9 is a partial side elevation section view of yet another embodiment of the invention installed into a cooperatively structured fluid applicator tip similar to that described in FIG. 1.

Referring lastly to FIG. 9, another alternate embodiment of the invention is there shown generally at numeral 10' , again in a form of a combination applicator kit 12' and a squeezable container B. The container B is again of a conventional nature and having a threaded neck N which threadably engages into mating internal threads 20' of connector body 18' in a conventional manner.

In this embodiment 10' , a separate flat plastic disc 80 is snugly positioned against the inner end of the connector body 18' and includes an elongated slit 82 formed there across extending across the central portion of the plastic disc 80 toward but not to the circular perimeter of the disc 80. By this means, the slit 82 formed across plastic disc 80 forms a full control valve function in a fashion similar to that described in FIG. 4.

To insure full and complete functioning of the disc 80 as a fluid flow control valve, a recess 84 is formed by an annular cavity 24' so that, as fluid pressure is applied in the direction of arrow by squeezing of bottle B, the necessary elastic deformation of the disc 80 immediately on either side of slit 82 occurs in unencumbered fashion.

While the instant invention has been shown and described herein in what are conceived to be the most practical and preferred embodiments, it is recognized that departures may be made therefrom within the scope of the invention, which is therefore not to be limited to the details disclosed herein, but is to be afforded the full scope of the claims so as to embrace any and all equivalent apparatus and articles.

What is claimed is:

1. A one-piece fluid flow control valve for use in a fluid applicator tip which is connectable onto an open end of a resiliently squeezable bottle, comprising;

a cup-shaped body formed of resilient material including a side wall and having a generally U-shaped longitudinal cross section which defines a hollow interior with an open end and an uninterrupted closed end, said body configured for coaxial alignment and seated retention within the applicator tip with said closed end oriented downstream of fluid flow through the applicator tip with respect to said open end;

a normally closed slit formed into said side wall in close proximity to said closed end, said slit opening to permit fluid entering into the hollow interior to flow through the opened said slit when the bottle is squeezed to increase fluid pressure against said closed end to open said slit;

said slit being normally closed when there is no substantial pressure within the bottle, preventing substantial fluid flow therethrough while also permitting air to flow therethrough in a reverse or upstream direction and drawn into the bottle after the bottle has been squeezed into a resilient distorted configuration to expel fluid and released.

2. A fluid control valve as set forth in claim 1, wherein:

said side wall is tapered toward said closed end to provide sufficient clearance between said closed end and a mating interior surface of the applicator tip to prevent interference with the opening movement of said slit.

3. A fluid control valve as set forth in claim 1, wherein said body further includes:

an annular flange extending outwardly from said open end which is adapted to seat against a mating interior surface of the applicator tip.

4. A fluid control valve as set forth in claim 1, wherein:

said slit is oriented orthogonally to a longitudinal axis of said body and substantially parallel to said closed end and extends through over half of the width of said body.

5. A fluid control valve as set forth in claim 1, wherein:

said slit is formed of two slit segments each substantially similar in size and orientation, and coplanar with respect to one another;

said slit portions extending from opposite sides of said body toward, but not to, a longitudinal axis of said body.

6. In combination, a one-piece fluid flow control valve within a fluid applicator tip which is connectable onto an open end of a resiliently squeezable bottle, said flow control valve comprising:

a cup-shaped body formed of resilient material including a side wall and having a generally U-shaped longitudinal cross section which defines a hollow interior with an open end and an uninterrupted closed end, said body configured for coaxial alignment and seated retention within said applicator tip with said closed end oriented downstream of fluid flow through said applicator tip with respect to said open end;

a normally closed slit formed into said side wall in close proximity to said closed end, said slit opening to permit fluid entering into the hollow interior from the bottle to flow through the opened said slit when the bottle is squeezed to increase fluid pressure against said closed end to open said slit;

said slit being normally closed when there is no substantial pressure within the bottle, preventing substantial fluid flow therethrough while also permitting air to flow therethrough in a reverse or upstream direction and drawn into the bottle after the bottle has been squeezed into a resilient distorted configuration to expel fluid and released.

7. A fluid control valve as set forth in claim 6, wherein:

said side wall is tapered toward said closed end to provide sufficient clearance between said closed end and a mating interior surface of the applicator tip to prevent interference with the opening movement of said slit.

8. A fluid control valve as set forth in claim 6, wherein said body further includes:

an annular flange extending outwardly from said open end which is adapted to seat against a mating interior surface of the applicator tip.

9. A fluid control valve as set forth in claim 6, wherein:

said slit is oriented orthogonally to a longitudinal axis of said body and substantially parallel to said closed end and extends through over half of the width of said body.

10. A fluid control valve as set forth in claim 6, wherein:

said slit is formed of two slit segments each substantially similar in size and orientation, and coplanar with respect to one another;

said slit portions extending from opposite sides of said body toward, but not to, a longitudinal axis of said body.

11. A one-piece fluid flow control valve for use in preventing excess fluid flow from a fluid applicator tip connected onto an open end of a resiliently squeezable bottle when held in an inverted orientation, comprising:

a cup-shaped body formed of resilient material and having a generally U-shaped configuration which defines a hollow interior with a side wall, an open end and an uninterrupted closed end, said body configured for coaxial alignment and seated retention within the applicator tip with said closed end oriented downstream of fluid flow through the applicator tip with respect to said open end;

a slit formed into said side wall in close proximity to said closed end, said slit opening to permit fluid entering into the hollow interior to flow through the opened said slit when the bottle, held in an inverted orientation with the applicator tip positioned downwardly, is squeezed to increase fluid pressure against said closed end to open said slit;

said slit being self-closing when there is no substantial pressure within the bottle, preventing substantial fluid flow therethrough while also permitting air to flow therethrough in a reverse or upstream direction and drawn into the bottle after the bottle is released from being squeezed.

12. A fluid control valve as set forth in claim 11, wherein:

said side wall is tapered toward said closed end to provide sufficient clearance between said closed end and mating interior surface of the applicator tip to prevent interference with the opening movement of said slit.

13. A fluid control valve as set forth in claim 11, wherein said body further includes:

an annular flange extending outwardly from said open end which is adapted to seat against a mating interior surface of the applicator tip.

14. A fluid control valve as set forth in claim 11, wherein:

said slit is oriented orthogonally to a longitudinal axis of said body and substantially parallel to said closed end and extends through over half of the width of said body.

15. A fluid control valve as set forth in claim 11, wherein:

said slit is formed of two slit segments each substantially similar in size and orientation, and coplanar with respect to one another;

said slit portions extending from opposite sides of said body toward, but not to, a longitudinal axis of said body.

* * * * *